US009858802B2

(12) United States Patent
Stafford

(10) Patent No.: US 9,858,802 B2
(45) Date of Patent: Jan. 2, 2018

(54) APPARATUS FOR TESTING FIRE ALARM SYSTEMS

(71) Applicant: Mark Anthony Stafford, Lake Park, FL (US)

(72) Inventor: Mark Anthony Stafford, Lake Park, FL (US)

( * ) Notice: Subject to any disclaimer, the term of this patent is extended or adjusted under 35 U.S.C. 154(b) by 118 days.

(21) Appl. No.: 15/043,742

(22) Filed: Feb. 15, 2016

(65) Prior Publication Data

US 2016/0247385 A1 Aug. 25, 2016

Related U.S. Application Data

(60) Provisional application No. 62/118,259, filed on Feb. 19, 2015.

(51) Int. Cl.
*G08B 29/02* (2006.01)
*G08B 25/08* (2006.01)
*G08B 29/00* (2006.01)

(52) U.S. Cl.
CPC ..... *G08B 29/02* (2013.01); *G08B 25/08* (2013.01)

(58) Field of Classification Search
None
See application file for complete search history.

(56) References Cited

U.S. PATENT DOCUMENTS

2003/0097188 A1* 5/2003 O'Mahoney ..... G05B 19/042 700/17
2010/0127849 A1* 5/2010 Barrieau ..... G08B 29/181 340/514

* cited by examiner

*Primary Examiner* — Joseph Feild
*Assistant Examiner* — John Mortell

(57) ABSTRACT

An apparatus for testing fire alarm systems allows for the remote resetting of a fire alarm system without being present proximal to a fire alarm control panel (FACP). The apparatus may also be used to test one or multiple notification appliances. The apparatus includes a portable control unit that is connected to the wiring of multiple notification appliances through a plurality of notification appliance circuit (NAC) connection terminals on the FACP or directly to a single notification appliance. An actuator for resetting a fire alarm system reset switch may be mounted to the FACP through an adjustable bracket. The length of the adjustable bracket may be adjusted in order to increase the versatility of the apparatus. A transmitter and a receiver may be utilized to remotely activate the fire alarm system reset switch as well as to activate one or multiple notification appliances during testing.

9 Claims, 8 Drawing Sheets

APPARATUS FOR TESTING FIRE ALARM SYSTEMS

The current application claims a priority to the U.S. Provisional Patent application Ser. No. 62/118,259 filed on Feb. 19, 2015.

FIELD OF THE INVENTION

The present invention relates generally to fire alarm systems. More specifically, the present invention is an apparatus for testing fire alarm systems that enables automatic resetting of a fire alarm system as well as area/zone notification appliance testing and individual notification appliance testing.

BACKGROUND OF THE INVENTION

A conventional fire alarm system generally comprises a number of initiating devices and alert devices that are connected to a fire alarm control panel (FACP). Initiating devices include smoke detectors and heat detectors that automatically detect a fire hazard and activate the alert devices. Alert devices generally include speakers or sirens that audibly broadcast a hazard warning. The alert devices may additionally include visual indicators as well such as lights. Some initiating devices such as pull stations that are normally distributed throughout a building may be manually operated in order to activate the alert devices. When an alert device has been activated, audible and visual warnings generally continue to sound and flash and the only way to disable the warnings is by resetting the fire alarm system via the FACP. Because of this, the process of testing a fire alarm system can be particularly tedious as the tester is required to manually reset the fire alarm system after activating one or more alert devices. This can be particularly bothersome if the fire alarm system encompasses a large area such as a multistory building. A second technician or similar personnel may be stationed near the FACP in order to increase the efficiency of a test.

The present invention is an apparatus for testing fire alarm systems. The present invention allows a fire alarm system to be reset remotely, eliminating the need to travel back to an FACP after triggering an initiating device. The present invention additionally enables the notification appliances within a specific area or zone (e.g. a particular floor of a building) to be tested. The notification appliances may be tested without triggering notification appliances outside of the specific area or zone that are connected to the FACP. The present invention may also be utilized to test a single notification appliance without triggering additional notification appliances.

DETAIL DESCRIPTIONS OF THE INVENTION

All illustrations of the drawings are for the purpose of describing selected versions of the present invention and are not intended to limit the scope of the present invention.

The present invention is an apparatus for testing fire alarm systems. The present invention enables a single user such as a technician to remotely reset a fire alarm system. The present invention is additionally utilized to perform tests on notification appliances within a specific area or zone (e.g. such as a single floor of a building) as well as to perform a test on an individual notification appliance.

Figure 1:
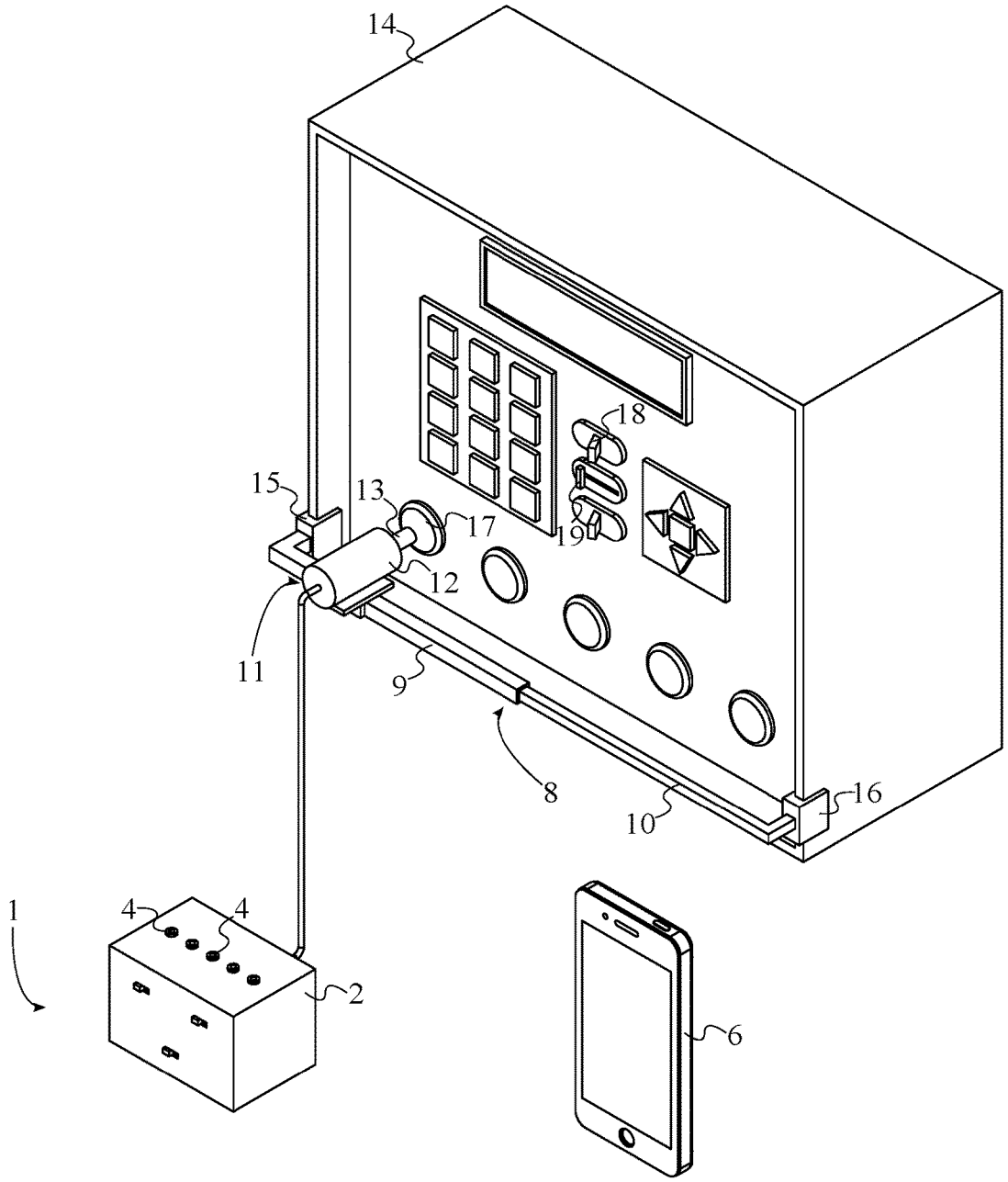
FIG. 1 is a perspective view of the present invention.
Figure 2:
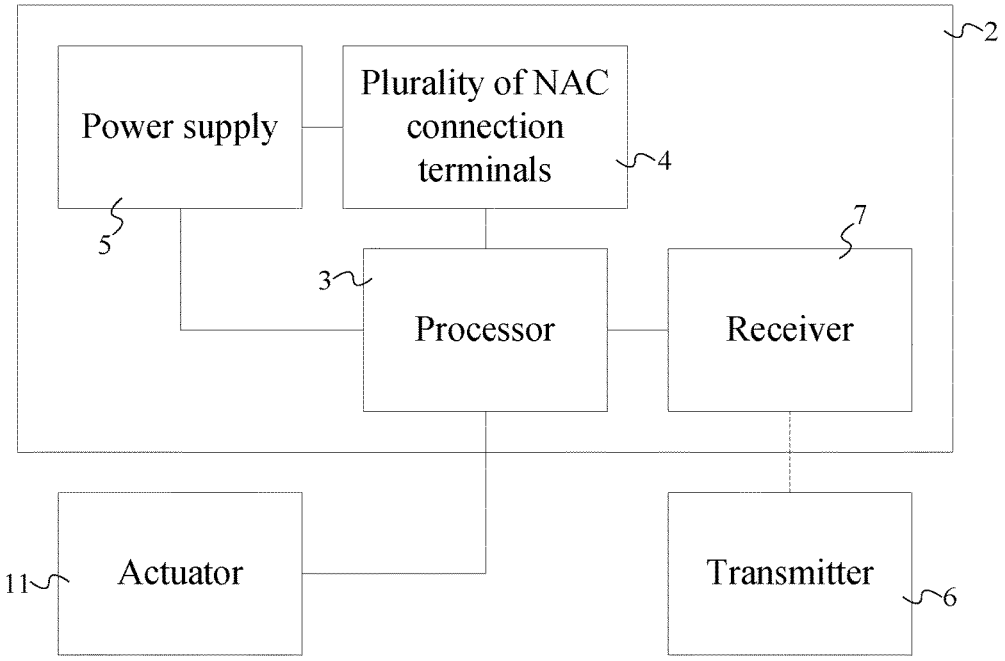
FIG. 2 is a diagram depicting electronic connections of the present invention.

The present invention is shown in FIG. 1 and FIG. 2 and comprises a portable control unit 1, a transmitter 6, and a receiver 7. The portable control unit 1 is utilized to electronically perform a variety of actions such as resetting a fire alarm system and testing the functionality of a notification appliance. The portable control unit 1 comprises an enclosure 2, a processor 3, a plurality of notification appliance circuit (NAC) connection terminals 4, and a power supply 5. The enclosure 2 provides physical protection for the electronic components of the portable control unit 1 and as such, the processor 3 and the power supply 5 are enclosed within the enclosure 2. The power supply 5 provides electrical power to the electronic components of the portable control unit 1. In the preferred embodiment of the present invention, the power supply 5 is electrically connected to the processor 3 and the plurality of NAC connection terminals 4 and is thus able to provide electrical power to the processor 3 and the plurality of NAC connection terminals 4. The power supply 5 is able to provide electrical power to any additional electronic components of the portable control unit 1 as well.

The transmitter 6 is utilized by the user to remotely relay commands to the portable control unit 1. As shown in FIG. 2, the transmitter 6 is communicatively coupled to the receiver 7 and as such, commands from the transmitter 6 are relayed to the receiver 7. The present invention may utilize various types of wireless communication protocols including, but not limited to, radio, Bluetooth, and Wi-Fi. The present invention is not limited with respect to the specific type of device utilized for the transmitter 6. Various example devices include, but not are not limited to, a smartphone and a tablet computer. In the preferred embodiment of the present invention, commands are transmitted wirelessly from the transmitter 6 to the receiver 7, enabling the user to remotely relay commands. The receiver 7 is electronically connected to the processor 3, allowing the processor 3 to execute the commands. Commands may be relayed from the receiver 7 to the processor 3 via a wired or wireless connection.

Again with reference to FIG. 1, the plurality of NAC connection terminals 4 is utilized to connect the wiring of notification appliances to the portable control unit 1. This enables the portable control unit 1 to be utilized to test one or more notification appliances. Within the context of the present invention, a notification appliance is an audible alarm unit (e.g. a horn, a prerecorded alert message), a visible light unit (e.g. a flashing strobe light), a combination thereof, or any alternative alerting device. The plurality of NAC connection terminals 4 is positioned on the enclosure 2 to allow the wiring of one or more notification appliances to be directly connected to the portable control unit 1 through the plurality of NAC connection terminals 4. The plurality of NAC connection terminals 4 is electronically connected to the processor 3. The processor 3 is thus able to initiate testing of one or more notification appliances that are connected to the portable control unit 1 through the corresponding terminals from the plurality of NAC connection terminals 4.

Figure 3:
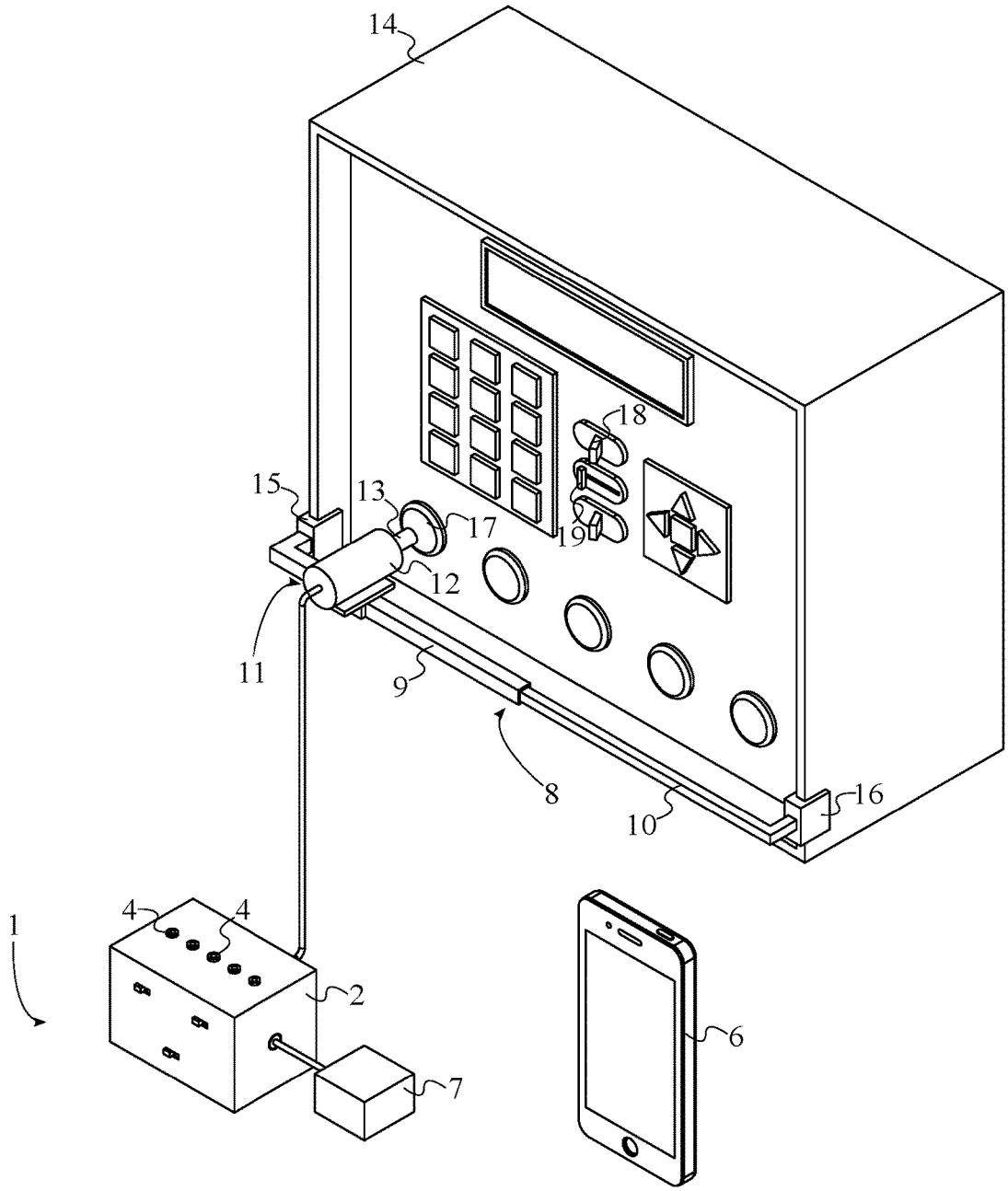
FIG. 3 is a perspective view of an embodiment of the present invention in which the receiver is a physically separate device.

In the embodiment of the present invention shown in FIG. 3, the receiver 7 is removably connected to the processor 3. This enables the use of the receiver 7 as a physically separate device that is connected and removed from the processor 3 as needed. Alternatively, the receiver 7 may be integrated with the portable control unit 1.

With further reference to FIGS. 1-3, the present invention may be utilized to remotely reset a fire alarm system, allowing the user to test the fire alarm system without being required to walk back to a fire alarm control panel (FACP) 14 in order to manually reset the fire alarm system. In the preferred embodiment of the present invention, this is accomplished via an adjustable bracket 8 and an actuator 11. The user is able to trigger one or more notification appliances via an initiating device such as a pull station. When the present invention is utilized to reset a fire alarm system, the actuator 11 physically activates a fire alarm system reset switch 17 that disables the one or more notification appliances that are being tested. The adjustable bracket 8 is utilized to secure the actuator 11 to the FACP 14. The adjustable bracket 8 is externally mounted to the FACP 14, allowing the position and orientation of the actuator 11 relative to the FACP 14 to be adjusted. The fire alarm system reset switch 17 is positioned on the FACP 14 as the FACP 14 serves as the control system for a fire alarm system. In the preferred embodiment of the present invention, the actuator 11 is electronically connected to the processor 3. The user is thus able to remotely relay a command via the transmitter 6 to the receiver 7. The command is implemented by the processor 3 and the actuator 11 is able to physically activate the fire alarm system reset switch 17. In this sense, the actuator 11 is able to engage the fire alarm system reset switch 17 in lieu of a technician or similar personnel being required to be present proximal to the FACP 14 when resetting the fire alarm system. In the preferred embodiment of the present invention, the actuator 11 is slidably mounted to the adjustable bracket 8, adjacent to the fire alarm system reset switch 17. The position of the actuator 11 may thus be adjusted as needed on the adjustable bracket 8.

In the preferred embodiment of the present invention, the actuator 11 is an electromechanical linear actuator and comprises a case 12 and a piston 13. The case 12 is the portion of the actuator 11 that houses the piston 13. As such, the piston 13 is slidably engaged into the case 12, enabling the piston 13 to protrude from the case 12 and engage the fire alarm system reset switch 17. The piston 13 is oriented toward the fire alarm system reset switch 17, allowing the piston 13 to come into contact with the fire alarm system reset switch 17 when the user wishes to reset the fire alarm system. The case 12 is mounted to the adjustable bracket 8, securing the actuator 11 to the adjustable bracket 8.

With continued reference to FIGS. 1-3, in its preferred embodiment, the present invention further comprises a first clamp 15 and a second clamp 16 that are utilized to secure the adjustable bracket 8 to the FACP 14. The present invention is not limited with respect to the specific type of clamps utilized to secure the adjustable bracket 8 to the FACP 14. For example, the first clamp 15 and the second clamp 16 may be mechanical C-clamps or magnetic clamps. The adjustable bracket 8 comprises a housing sleeve 9 and an extension shaft 10 that enable the length of the adjustable bracket 8 to be changed as needed. The extension shaft 10 is telescopically engaged into the housing sleeve 9 to enable the length of the adjustable bracket 8 to be increased or decreased. The first clamp 15 is connected to the housing sleeve 9 and serves as a means of securing the housing sleeve 9 to the FACP 14. Similarly, the second clamp 16 is connected to the extension shaft 10 and serves as a means of securing the extension shaft 10 to the FACP 14. The housing sleeve 9 and the extension shaft 10 are removably mounted to the FACP 14 through the first clamp 15 and the second clamp 16, respectively. The housing sleeve 9 and the extension shaft 10 may thus be easily attached to or removed from the FACP 14 as needed. In various embodiments of the present invention, the adjustable bracket 8 may be adapted to the FACP 14 by various other means such as by simply moving the first clamp 15 and the second clamp 16 to the appropriate position.

Figure 4:
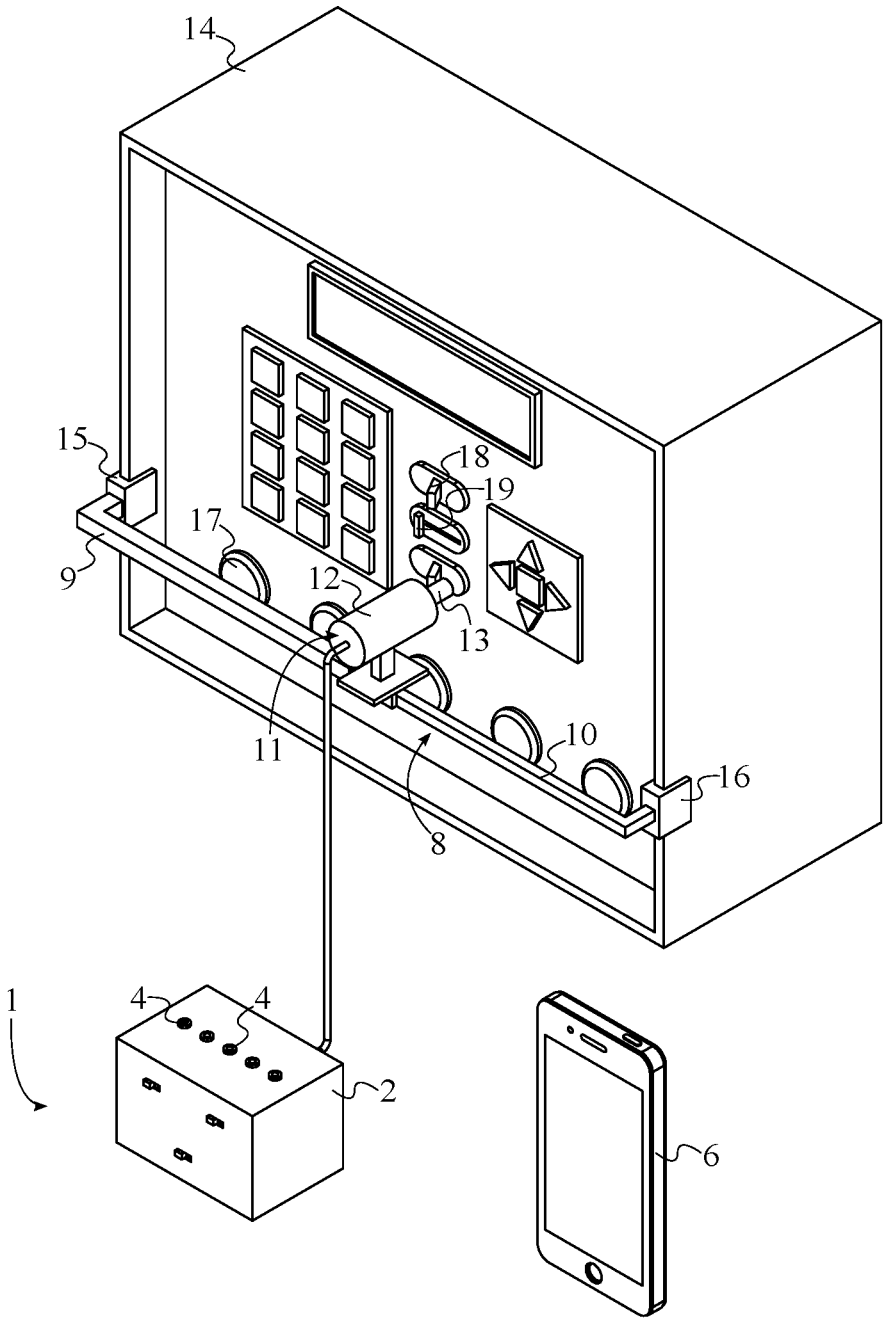
FIG. 4 is a perspective view of an embodiment of the present invention in which the actuator is utilized to engage at least one flip switch.
Figure 5:
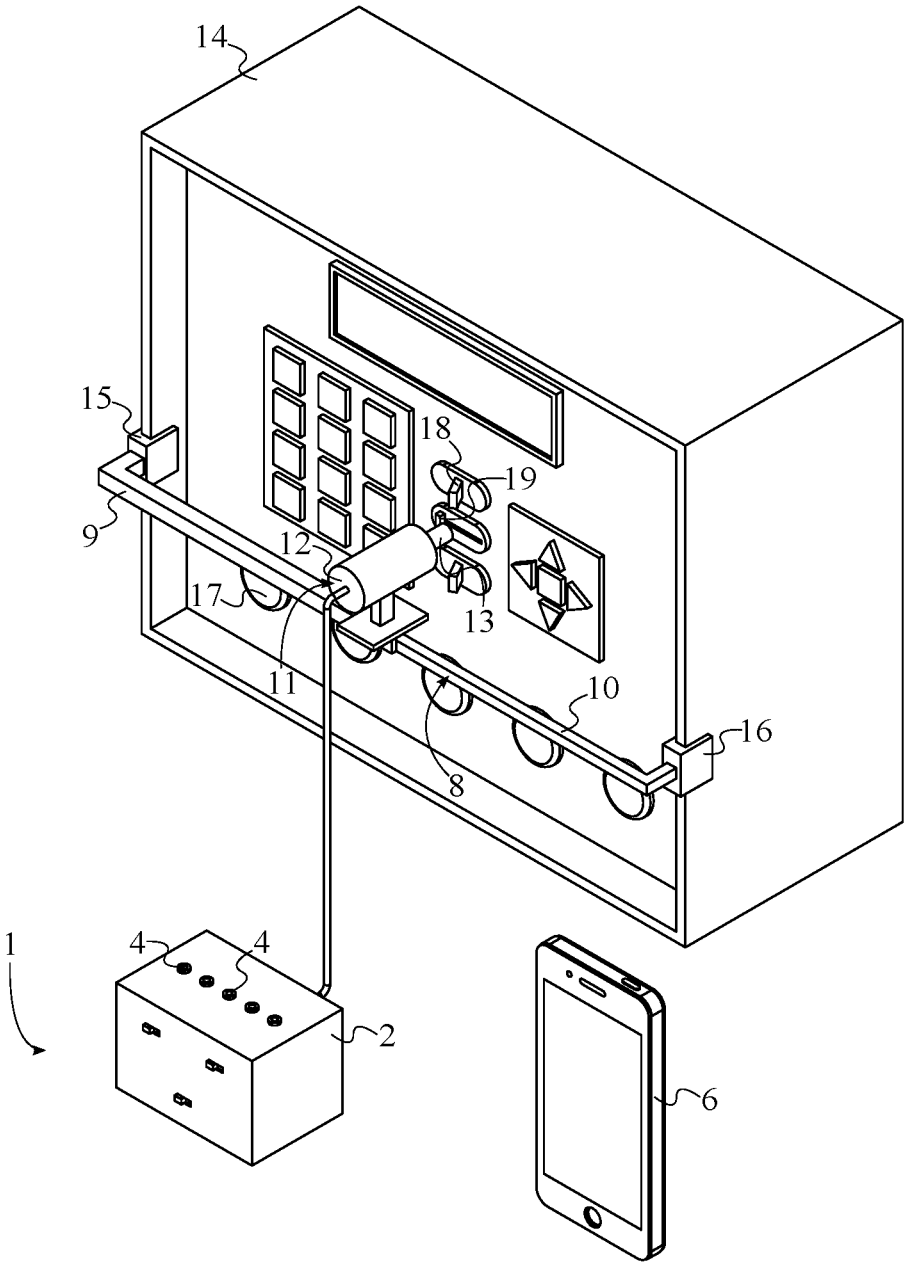
FIG. 5 is a perspective view of an embodiment of the present invention in which the actuator is utilized to engage at least one toggle switch.

In addition to resetting a fire alarm system, the actuator 11 may be utilized to perform a variety of other actions. The actuator 11 is thus able to engage a variety of additional switch types as well. In the embodiment of the present invention shown in FIG. 4, the actuator 11 is shown in use with at least one toggle switch 18. In this configuration, the actuator 11 is slidably mounted to the adjustable bracket 8, adjacent to the at least one toggle switch 18. This enables the piston 13 to engage the at least one toggle switch 18 as needed. The present invention is not limited with respect to the specific type of actuator 11 and an alternative to the preferred electromechanical linear actuator may be utilized as needed. The embodiment of the present invention shown in FIG. 5 depicts the actuator 11 in use with at least one slide switch 19. The actuator 11 is slidably mounted to the adjustable bracket 8, adjacent to the at least one slide switch 19, enabling the piston 13 to engage the at least one slide switch 19 as needed.

Figure 6:
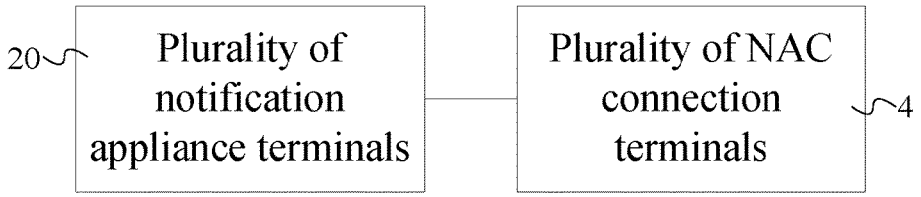
FIG. 6 is a diagram depicting additional electronic connections of an embodiment of the present invention in which the present invention is used to test multiple notification appliances within an area or zone.

With reference to FIG. 1, FIG. 2 and FIG. 6, the present invention may be utilized to test multiple notification appliances within a specific area or zone simultaneously. A structure is typically divided into defined areas or zones with notification appliances in the fire alarm system generally divided into these areas or zones as well. The notification appliances within an area or zone may be configured to activate simultaneously. The FACP 14 comprises a plurality of notification appliance terminals 20 that enables the wiring for notification appliances to be connected to the portable control unit 1. In this configuration of use, the portable control unit 1 and the receiver 7 are positioned adjacent to the FACP 14 to facilitate connection of the notification appliances to the portable control unit 1. Each of the plurality of notification appliance terminals 20 is electronically connected to a corresponding terminal from the plurality of NAC connection terminals 4. The notification appliances within the area or zone that the user wishes to test may thus be connected directly to the portable control unit 1. The user is able to travel to the area or zone to be tested and remotely short the wiring of the notification appliances via the transmitter 6. The notification appliances that are connected to the portable control unit 1 are then activated.

Figure 7:
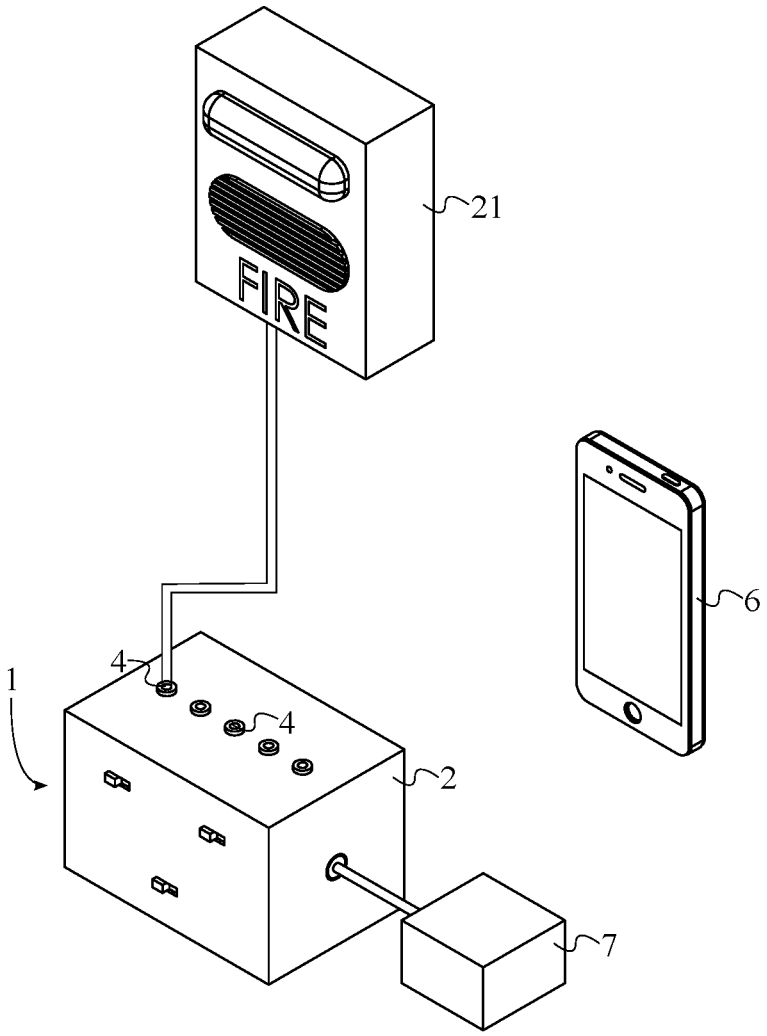
FIG. 7 is a perspective view of an embodiment of the present invention in which the present invention is used to independently test a single notification appliance.
Figure 8:
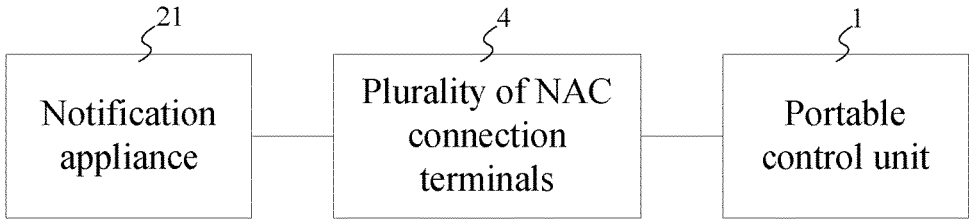
FIG. 8 is a diagram depicting additional electronic connections of the embodiment of the present invention in which the present invention is used to independently test the single notification appliance.

In addition to testing multiple notification appliances simultaneously, the present invention may be utilized to independently test a single notification appliance 21 as shown in FIG. 7 and FIG. 8. In this configuration of use, the portable control unit 1 and the receiver 7 are positioned adjacent to the notification appliance 21 to facilitate connection of the wiring of the notification appliance 21 to the portable control unit 1. The notification appliance 21 is electronically connected to the portable control unit 1 through a corresponding terminal from the plurality of NAC connection terminals 4. This enables the single notification appliance 21 to be tested independently of other notification appliances. The user is able to short the wiring of the notification appliance 21 via the transmitter 6, activating the notification appliance 21 independently of other notification appliances. Unlike when testing multiple notification appliances within a specific area or zone, the notification appliance 21 in this configuration of use is connected directly to the portable control unit 1 rather than through the FACP 14. Because the user is positioned proximal to the portable control unit 1 in this configuration of the present invention, the transmitter 6 and the receiver 7 may be replaced via a designated activation switch on the portable control unit 1. The designated activation switch may then be utilized to short the wiring of the notification appliance 21 in lieu of the transmitter 6.

Although the present invention has been explained in relation to its preferred embodiment, it is understood that many other possible modifications and variations can be made without departing from the spirit and scope of the present invention as hereinafter claimed.

What is claimed is:

1. An apparatus for testing fire alarm systems comprises:
a portable control unit;
a transmitter;
a receiver;
a fire alarm control panel (FACP);
an adjustable bracket;
an actuator;
a fire alarm system reset switch;
the portable control unit comprises an enclosure, a processor, a plurality of notification appliance circuit (NAC) connection terminals, and a power supply;
the processor and the power supply being enclosed within the enclosure;
the transmitter being communicatively coupled to the receiver;
the receiver being electronically connected to the processor;
the plurality of NAC connection terminals being positioned on the enclosure;
the plurality of NAC connection terminals being electronically connected to the processor;
the power supply being electrically connected to the processor and the plurality of NAC connection terminals;
the adjustable bracket being externally mounted to the FACP;
the adjustable bracket comprises two clamps configured to be releasably secured to the FACP;
the adjustable bracket comprises a housing sleeve and an extension shaft that enable the length of the adjustable bracket to be changed;
the fire alarm system reset switch being positioned on the FACP; and
the actuator being electronically connected to the processor.

2. The apparatus for testing fire alarm systems as claimed in claim 1 further comprises:
the receiver being removably connected to the processor.

3. The apparatus for testing fire alarm systems as claimed in claim 1 further comprises:
a first clamp;
a second clamp;
the adjustable bracket comprises a housing sleeve and an extension shaft;
the extension shaft being telescopically engaged into the housing sleeve;
the first clamp being connected to the housing sleeve;
the second clamp being connected to the extension shaft; and
the housing sleeve and the extension shaft being removably mounted to the FACP through the first clamp and the second clamp, respectively.

4. The apparatus for testing fire alarm systems as claimed in claim 1 further comprises:
the actuator being slidably mounted to the adjustable bracket, adjacent to the fire alarm system reset switch.

5. The apparatus for testing fire alarm systems as claimed in claim 1 further comprises:
the actuator comprises a case and a piston;
the case being mounted to the adjustable bracket;
the piston being slidably engaged into the case; and
the piston being oriented toward the fire alarm system reset switch.

6. The apparatus for testing fire alarm systems as claimed in claim 1 further comprises:
at least one toggle switch; and
the actuator being slidably mounted to the adjustable bracket, adjacent to the at least one toggle switch.

7. The apparatus for testing fire alarm systems as claimed in claim 1 further comprises:
at least one slide switch; and
the actuator being slidably mounted to the adjustable bracket, adjacent to the at least one slide switch.

8. The apparatus for testing fire alarm systems as claimed in claim 1 further comprises:
an FACP;
the FACP comprises a plurality of notification appliance terminals;
the portable control unit and the receiver being positioned adjacent to the FACP; and
each of the plurality of notification appliance terminals being electronically connected to a corresponding terminal from the plurality of NAC connection terminals.

9. The apparatus for testing fire alarm systems as claimed in claim 1 further comprises:
a notification appliance;
the portable control unit and the receiver being positioned adjacent to the notification appliance; and
the notification appliance being electronically connected to the portable control unit through a corresponding terminal from the plurality of NAC connection terminals.

* * * * *